US010962906B2

(12) United States Patent
Watanabe

(10) Patent No.: US 10,962,906 B2
(45) Date of Patent: Mar. 30, 2021

(54) IMAGE FORMING APPARATUS INCLUDING A TRANSPORT MEMBER AND A TRANSFER DEVICE

(71) Applicant: FUJI XEROX CO., LTD., Tokyo (JP)

(72) Inventor: Kanji Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/797,921

(22) Filed: Feb. 21, 2020

(65) Prior Publication Data

US 2020/0192250 A1 Jun. 18, 2020

Related U.S. Application Data

(63) Continuation of application No. 16/224,327, filed on Dec. 18, 2018, now Pat. No. 10,599,073, which is a continuation of application No. 15/583,265, filed on May 1, 2017, now Pat. No. 10,175,613.

(30) Foreign Application Priority Data

Sep. 28, 2016 (JP) ..... 2016-189212

(51) Int. Cl.
*G03G 15/16* (2006.01)

(52) U.S. Cl.
CPC ..... *G03G 15/161* (2013.01); *G03G 15/1615* (2013.01)

(58) Field of Classification Search
None
See application file for complete search history.

(56) References Cited

U.S. PATENT DOCUMENTS

| | | | | |
|---|---|---|---|---|
| 2004/0086289 | A1 | 5/2004 | Deguchi | |
| 2016/0077481 | A1 | 3/2016 | Katano et al. | |
| 2016/0161895 | A1* | 6/2016 | Sasaki | G03G 15/6582 399/407 |
| 2017/0060035 | A1* | 3/2017 | Tsuno | G03G 15/652 |
| 2017/0168444 | A1* | 6/2017 | Kobayashi | G03G 15/2028 |

FOREIGN PATENT DOCUMENTS

| | | | |
|---|---|---|---|
| JP | 2004209873 A | * | 7/2004 |
| JP | 2008-185638 A | | 8/2008 |
| JP | 2010097132 A | | 4/2010 |
| JP | 2015-25920 A | | 2/2015 |
| JP | 5710054 B1 | | 4/2015 |

OTHER PUBLICATIONS

JP_2004209873_A_T MachineTranslation, Jul. 2004, Japan, Shimoyama.*
JP_2010097132_A_T Machine Translation, Maeda, Japan, 2009.

* cited by examiner

*Primary Examiner* — Victor Verbitsky
(74) *Attorney, Agent, or Firm* — Sughrue Mion, PLLC

(57) ABSTRACT

An image forming apparatus includes a transport member that transports a continuous medium as a result of a transport surface of the transport member making contact with the continuous medium and a transfer device that is disposed on a downstream side in a direction in which the transport member transports the medium and that transfers an image onto the medium, which extends to the transport member, as a result of a transfer surface of the transfer device making contact with the medium. A moving speed of the transfer surface is lower than a moving speed of the transport surface when the medium is transported.

3 Claims, 8 Drawing Sheets

IMAGE FORMING APPARATUS INCLUDING A TRANSPORT MEMBER AND A TRANSFER DEVICE

CROSS-REFERENCE TO RELATED APPLICATIONS

This application is a Continuation of U.S. application Ser. No. 16,224,327, filed Dec. 18, 2018, which is a Continuation of U.S. application Ser. No. 15/583,265 filed May 1, 2017, (now issued as U.S. Pat. No. 10,175,613), which is based on and claims priority under 35 USC 119 from Japanese Patent Application No. 2016-189212 filed Sep. 28, 2016, the disclosures of which are incorporated herein in their entireties by reference.

BACKGROUND

Technical Field

The present invention relates to an image forming apparatus.

SUMMARY

According to an aspect of the invention, there is provided an image forming apparatus including a transport member that transports a continuous medium as a result of a transport surface of the transport member making contact with the continuous medium and a transfer device that is disposed on a downstream side in a direction in which the transport member transports the medium and that transfers an image onto the medium, which extends to the transport member, as a result of a transfer surface of the transfer device making contact with the medium. A moving speed of the transfer surface is lower than a moving speed of the transport surface when the medium is transported.

BRIEF DESCRIPTION OF THE DRAWINGS

Exemplary embodiments of the present invention will be described in detail based on the following figures, wherein.

DETAILED DESCRIPTION

Figure 1:
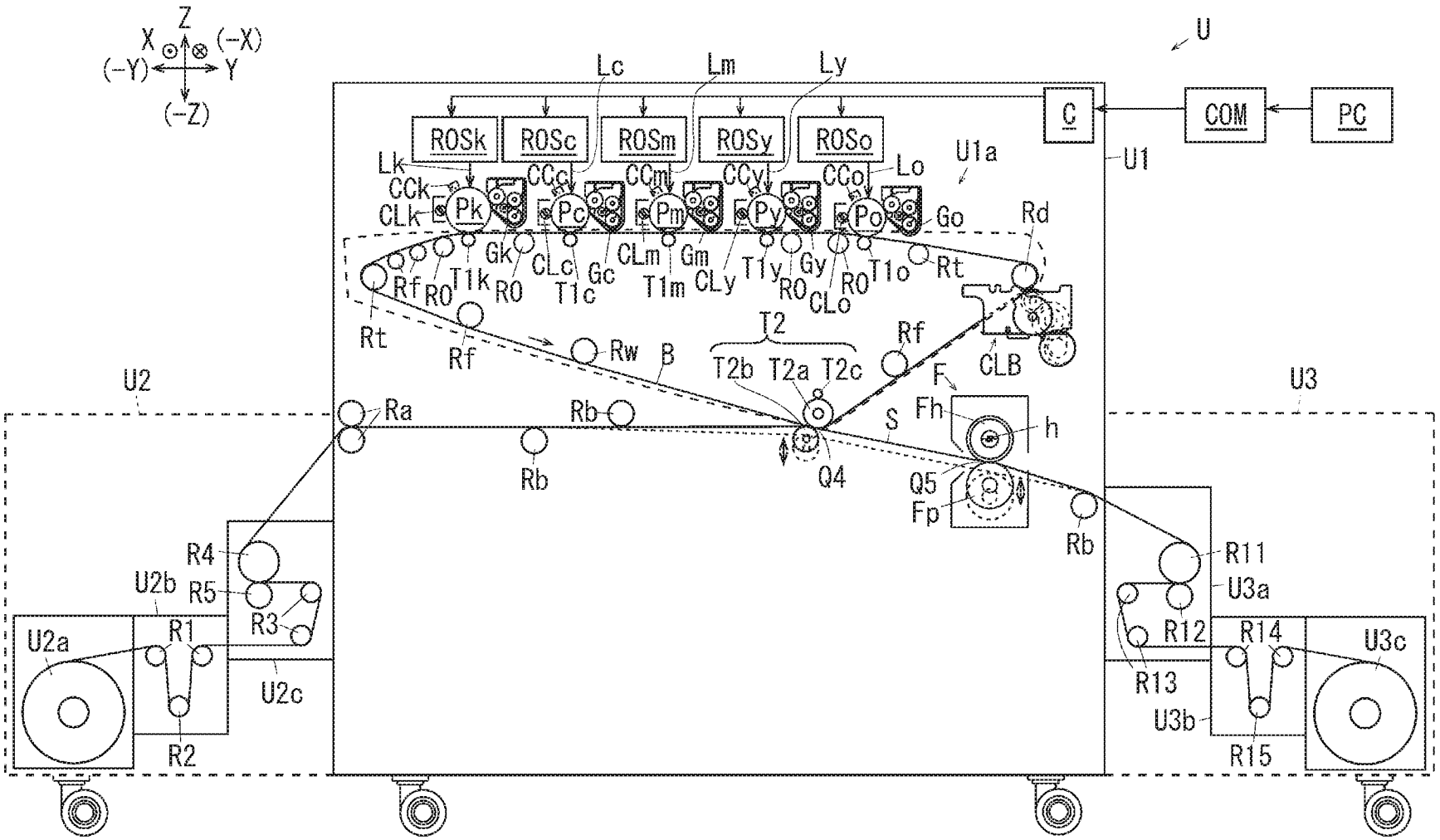
FIG. 1 is an overall view of an image forming apparatus according to an exemplary embodiment of the present invention.

Although an exemplary embodiment of the present invention will now be described below as a specific example with reference to the drawings, the present invention is not limited to the following exemplary embodiment.

For ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or the front side, the rear side, the right side, the left side, the top side, and the bottom side.

An arrow extending from the rear side to the front side in the drawings is denoted by an encircled dot, and an arrow extending from the front side to the rear side in the drawings is denoted by an encircled cross.

In the following description, which refers to the drawings, descriptions and illustration of components that are not necessarily illustrated are suitably omitted for ease of understanding.

Exemplary Embodiment (Description of Overall Configuration of Printer U According to Exemplary Embodiment)

FIG. 1 is an overall view of an image forming apparatus according to an exemplary embodiment of the present invention.

In FIG. 1, a printer U, which is an example of an image forming apparatus according to the exemplary embodiment, includes a printer body U1, a feeder unit U2, which is an example of a feeding unit that feeds a medium to the printer body U1, and a taking-up unit U3, which is an example of a taking-up device that takes up a medium on which an image has been recorded.

(Description of Configuration of Marking Unit According to Exemplary Embodiment)

In FIG. 1, the printer body U1 includes a controller C that performs control of the printer U, a communicating unit (not illustrated) that receives image information transmitted by a print-image server COM, which is an example of an information-transmission apparatus that is provided outside the printer U and connected to the printer U by using a dedicated cable (not illustrated), and a marking unit U1*a*, which is an example of an image recording unit that records an image onto a medium. A personal computer PC, which is an example of an image transmission apparatus, is connected to the print-image server COM by using a wired or wireless communication line so as to transmit information regarding an image to be printed by the printer U.

The marking unit U1*a* includes photoconductors Py, Pm, Pc, and Pk that respectively correspond to yellow (Y), magenta (M), cyan (C), and black (K) and each of which is an example of an image carrier, and a photoconductor Po. As an example, when printing a photographic image or the like, the photoconductor Po is used in order to form an image by using a gloss toner that provides the image with gloss.

In FIG. 1, a charger CCk, an exposure device ROSk, which is an example of a latent-image forming device, a developing unit GK, a first transfer roller T1*k*, which is an example of a first transfer unit, and a photoconductor cleaner CLk, which is an example of an image-carrier-cleaning unit, are disposed around the photoconductor Pk, which corresponds to color K, along a direction in which the photoconductor Pk rotates.

Similarly, a charger CCy, an exposure device ROSy, a developing unit Gy, a first transfer roller T1*y*, and a photoconductor cleaner CLy are disposed around the photoconductor Py. A charger CCm, an exposure device ROSm, a developing unit Gm, a first transfer roller T1*m*, and a photoconductor cleaner CLm are disposed around the photoconductor Pm. A charger CCc, an exposure device ROSc, a developing unit Gc, a first transfer roller T1*c*, and a photoconductor cleaner CLc are disposed around the photoconductor Pc. A charger CCo, an exposure device ROSo, a developing unit Go, a first transfer roller T1*o*, and a photoconductor cleaner CLo are disposed around the photoconductor Po.

An intermediate transfer belt B, which is an example of an intermediate transfer body and an example of an image carrier, is disposed below the photoconductors Py to Po, and the intermediate transfer belt B is sandwiched between the photoconductors Py to Po and the first transfer rollers T1*y* to T1*o*. The rear surface of the intermediate transfer belt B is supported by a drive roller Rd, which is an example of a driving member, a tension roller Rt, which is an example of a tension-applying member, a working roller Rw, which is an example of a member that prevents the intermediate transfer belt B from moving in a serpentine manner, plural idle rollers Rf, each of which is an example of a driven member, a backup roller T2*a*, which is an example of an opposing member for use in a second transfer process, plural retract rollers R0, each of which is an example of a movable member, and the first transfer rollers T1*y* to T1*o*.

A belt cleaner CLB, which is an example of an intermediate-transfer-body cleaning unit, is disposed on the front surface of the intermediate transfer belt B in such a manner as to be positioned in the vicinity of the drive roller Rd.

A second transfer roller T2*b*, which is an example of an opposing member, an example of a transfer member, and an example of a second transfer member, is disposed in such a manner as to face the backup roller T2*a* with the intermediate transfer belt B interposed therebetween. Note that the second transfer roller T2*b* according to the exemplary embodiment is in contact with the intermediate transfer belt B at a position that is offset with respect to a lower end, which is the center of winding of the intermediate transfer belt B around the backup roller T2*a*, on the upstream side in a rotation direction of the intermediate transfer belt B. The second transfer roller T2*b* according to the exemplary embodiment is pressed against the backup roller T2*a* by a spring (not illustrated), which is an example of an urging member.

In addition, a contact roller T2*c*, which is an example of a contact member, is in contact with the backup roller T2*a* in order to apply a voltage having a polarity opposite to the charge polarities of developers to the backup roller T2*a*.

A second transfer device T2 according to the exemplary embodiment, which is an example of a transfer device, is formed of the backup roller T2*a*, the second transfer roller T2*b*, and the contact roller T2*c*. Transfer devices T1, B, and T2 according to the exemplary embodiment are formed of the first transfer rollers T1*y* to T1*o*, the intermediate transfer belt B, the second transfer device T2, and the like.

In the feeder unit U2, a sheet-feeding member U2*a* by which a continuous sheet S, which is an example of a continuous medium, has been rolled up is rotatably supported. The continuous sheet S extending from the sheet-feeding member U2*a* is sent out to a first tension-adjusting mechanism U2*b*. The first tension-adjusting mechanism U2*b* includes a pair of guide rollers R1, each of which is an example of a guiding member. The pair of guide rollers R1 are arranged along a transport direction of the continuous sheet S. A dancer roller R2, which is an example of a tension-applying member, is disposed between the guide rollers R1. The dancer roller R2 is supported in a state of being in contact with a surface of the continuous sheet S and is capable of freely moving up and down. Thus, the dancer roller R2 exerts tension on the continuous sheet S by its own weight. Note that rotation of the sheet-feeding member U2*a* according to the exemplary embodiment is controlled such that the sheet-feeding member U2*a* sends out the continuous sheet S when the dancer roller R2 is positioned above a predetermined feeding height and stops feeding the continuous sheet S when the dancer roller R2 is positioned below a predetermined discontinuing height.

A sheet-feeding mechanism U2*c*, which is an example of a transport device for the continuous sheet S, is disposed downstream from the first tension-adjusting mechanism U2*b* in the transport direction of the continuous sheet S. The sheet-feeding mechanism U2*c* includes plural guide rollers R3, each of which is an example of a guiding member. A sheet-feeding roller R4, which is an example of a transport member, an example of a driving member, and an example of a sheet-feeding member, is disposed downstream from the guide rollers R3. A clamping roller R5, which is an example of an opposing member, is disposed such that the continuous sheet S is interposed between the sheet-feeding roller R4 and the clamping roller R5. The sheet-feeding roller R4 feeds the continuous sheet S at a predetermined transport speed at which the continuous sheet S is to be transported. The clamping roller R5 clamps the continuous sheet S together with the sheet-feeding roller R4 at a predetermined pressure in order to reduce the likelihood of the sheet-feeding roller R4 and the continuous sheet S sliding over each other. In addition, in order to reduce the likelihood of the sheet-feeding roller R4 and the continuous sheet S sliding over each other, the guide rollers R3 guide the continuous sheet S along a path so as to increase the area in which the continuous sheet S is wound around the sheet-feeding roller R4.

The continuous sheet S sent out by the sheet-feeding mechanism U2*c* is nipped by transport rollers Ra that are disposed at an entrance to the printer body U1, each of the transport rollers Ra being an example of a transport member. Plural guide rollers Rb, each of which is an example of a guiding member, are disposed on the right-hand side of the transport rollers Ra. Each of the guide rollers Rb according to the exemplary embodiment has a roll-like shape so as to be rotatable.

A fixing device F is disposed downstream from the second transfer roller T2*b* in the transport direction of the continuous sheet S. The fixing device F includes a heating roller Fh, which is an example of a heating member, and a pressure roller Fp, which is an example of a pressure member. A heater h, which is an example of a heat source, is accommodated in the heating roller Fh.

Another guide roller Rb, which is an example of a guiding member, is rotatably supported at a position downstream from the fixing device F. The taking-up unit U3 is disposed downstream from the guide roller Rb. The taking-up unit U3 includes a discharge mechanism U3*a*. A pull roller R11, which is an example of a transport member, an example of a driving member, and an example of a discharge member, is disposed in the discharge mechanism U3*a*. A clamping roller R12, which is an example of an opposing member, is disposed such that the continuous sheet S is interposed between the pull roller R11 and the clamping roller R12. The pull roller R11 transports the continuous sheet S to the downstream side at a predetermined transport speed. The clamping roller R12 clamps the continuous sheet S together with the pull roller R11 at a predetermined pressure in order to reduce the likelihood of the pull roller R11 and the continuous sheet S sliding over each other. Guide rollers R13, each of which is an example of a guiding member, are disposed downstream from the clamping roller R12 in the transport direction of the continuous sheet S. In addition, in order to reduce the likelihood of the pull roller R11 and the continuous sheet S sliding over each other, the guide rollers R13 guide the continuous sheet S along a path so as to increase the area in which the continuous sheet S is wound around the pull roller R11.

A second tension-adjusting mechanism U3*b* is disposed downstream from the discharge mechanism U3*a* in the transport direction of the continuous sheet S. The second tension-adjusting mechanism U3*b* is configured in a similar manner to the first tension-adjusting mechanism U2*b*. Accordingly, the second tension-adjusting mechanism U3*b* includes a pair of guide rollers R14 and a dancer roller R15.

A winding roller U3*c*, which is an example of a taking-up member, is disposed downstream from the second tension-adjusting mechanism U3*b* in the transport direction of the continuous sheet S. The winding roller U3*c* winds up the continuous sheet S. Note that the winding roller U3*c* winds up the continuous sheet S when the dancer roller R15 is positioned below a predetermined winding-up height and stops winding up the continuous sheet S when the dancer roller R15 is positioned above a predetermined discontinuing height.

(Operation of Marking Unit)

When the printer U receives image information sent by the personal computer PC via the print-image server COM, a job, which is an image forming operation, is started. Once the job has been started, the photoconductors Py to Po, the intermediate transfer belt B, and the like rotate.

Each of the photoconductors Py to Po is driven by a driving source (not illustrated) so as to rotate.

A predetermined voltage is applied to each of the chargers CCy to CCo, and the chargers CCy to CCo charges the surfaces of the corresponding photoconductors Py to Po.

The exposure devices ROSy to ROSo respectively output laser beams Ly, Lm, Lc, Lk, and Lo, each of which is an example of a light beam that writes a latent image, in accordance with control signals from the controller C so as to write an electrostatic latent image onto the charged surfaces of the corresponding photoconductors Py to Po.

The developing units Gy to Go develop the electrostatic latent images on the surfaces of the corresponding photoconductors Py to Po into visible images.

A first transfer voltage having a polarity opposite to the charge polarities of the developers is applied to the first transfer rollers T1*y* to T1*o*, and the first transfer rollers T1*y* to T1*o* transfer the visible images on the surfaces of the corresponding photoconductors Py to Po onto the front surface of the intermediate transfer belt B.

The photoconductor cleaners CLy to CLo clean the surfaces of the corresponding photoconductors Py to Po by removing the developers that remaining on the surfaces after a first transfer process has been performed.

When the intermediate transfer belt B passes through a first transfer region that faces the photoconductors Py to Po, an image formed by using a gloss toner and images of colors Y, M, C, and K are transferred onto the intermediate transfer belt B in this order so as to be stacked on top of one another, and then the intermediate transfer belt B passes through a second transfer region Q4 that faces the second transfer device T2. Note that, in the case of a monochromatic image, only an image of a single color is transferred onto the intermediate transfer belt B and sent to the second transfer region Q4.

The transport rollers Ra transport the continuous sheet S extending from the feeder unit U2 to the downstream side. The guide rollers Rb guide the continuous sheet S to the second transfer region Q4.

In the second transfer device T2, a predetermined second transfer voltage having a polarity that is the same as the charge polarities of the developers is applied to the backup roller T2*a* via the contact roller T2*c*, and the images on the intermediate transfer belt B are transferred onto the continuous sheet S.

The fixing device F applies heat and pressure to the continuous sheet S that passes through a fixing region Q5, in which the heating roller Fh and the pressure roller Fp are brought into contact with each other, so as to fix unfixed images on the surface of the continuous sheet S onto the continuous sheet S.

The taking-up unit U3 winds up the continuous sheet S to which the images have been fixed.

(Description of Second Transfer Device T2)

Figure 2:
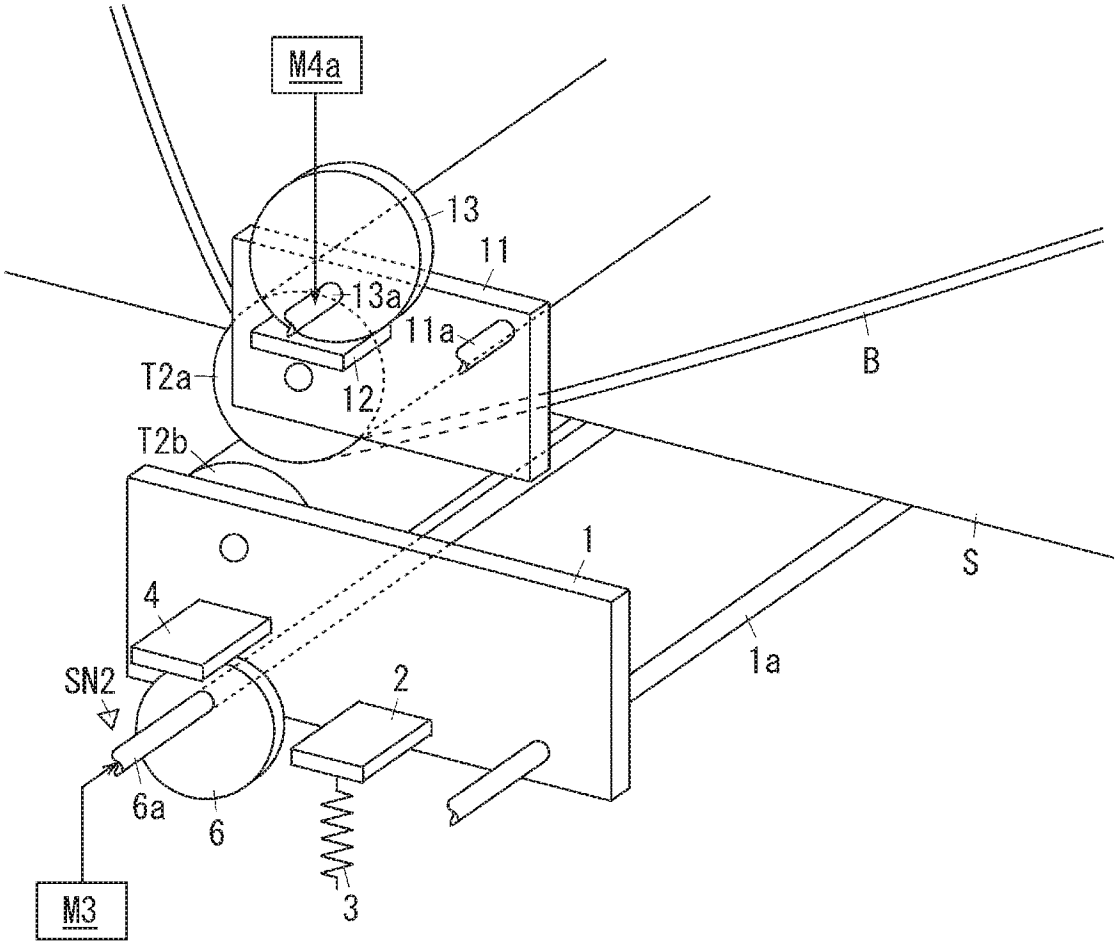
FIG. 2 is a diagram illustrating a second transfer device according to the exemplary embodiment.

FIG. 2 is a diagram illustrating the second transfer device according to the exemplary embodiment.

Although a raising-and-lowering mechanism and a press-contact-degree correction mechanism of the second transfer roller T2*b* will be described below with reference to FIG. 2, since portions of the mechanisms on a first end side of the second transfer roller T2*b* and portions of the mechanisms on a second end side of the second transfer roller T2*b* in the axial direction of the second transfer roller T2*b* are symmetrically arranged, only the portions of the mechanisms on the front side will be described and illustrated, and detailed descriptions of the portions of the mechanisms on the rear side will be omitted.

In FIG. 2, the end portions of the second transfer roller T2*b*, which is an example of the transfer member according to the exemplary embodiment, are rotatably supported by raising-and-lowering plates 1, each of which is an example of a movable member. In FIG. 2, the front raising-and-lowering plate 1 is supported so as to be rotatable about a lower-right rotary shaft 1*a*. A spring attachment portion 2, which is an example of a portion to which an urging member to be attached, is supported on the raising-and-lowering plate 1 so as to be disposed on the left-hand side of the rotary shaft 1*a*. The spring attachment portion 2 is formed in a plate-like shape projecting outward in the axial direction of the second transfer roller T2*b*.

A spring 3, which is an example of an urging member, is disposed between the spring attachment portion 2 and a frame body (not illustrated) of the printer body U1. The spring 3 according to the exemplary embodiment urges the spring attachment portion 2 downward, that is, in a direction in which the second transfer roller T2*b* moves away from the continuous sheet S, the intermediate transfer belt B, and the backup roller T2*a*.

A cam follower 4, which is an example of a contact portion, is supported on the raising-and-lowering plate 1 so as to be disposed on the left-hand side of the spring attachment portion 2. The cam follower 4 is formed in a plate-like shape projecting outward in the axial direction of the second transfer roller T2*b*. One of eccentric cams 6, each of which is an example of an actuating member, is disposed below the cam follower 4. The eccentric cams 6 are supported so as to be rotatable about a rotary shaft 6*a*. Note that the rotary shaft 6*a* of the eccentric cams 6 supports both the pair of front and rear eccentric cams 6 and is configured in such a manner that the pair of front and rear eccentric cams 6 integrally rotate along with rotation of the rotary shaft 6*a*. In the exemplary embodiment, the rotary shaft 6*a* is provided with a rotation sensor SN2, which is an example of a sensing member. The rotation sensor SN2 is capable of detecting a rotation amount of the eccentric cams 6.

The rotary shaft 6*a* of the eccentric cams 6 is capable of receiving a driving force that is transmitted from a contact-retract motor M3 for use in a transfer process, which is an example of a driving source. In the exemplary embodiment, the second transfer roller T2*b* is set to move between a contact position and a retract position each time the eccentric cams 6 rotate 180 degrees. The second transfer roller T2*b* is set to move to the contact position when one of the eccentric cams 6 according to the exemplary embodiment is brought into contact with the cam follower 4 at a position where the distance from the rotary shaft 6*a* to the outer peripheral surface of the eccentric cam 6 is longest. In addition, the second transfer roller T2*b* is set to move to the retract position when the eccentric cam 6 is brought into contact with the cam follower 4 at a position where the distance from the rotary shaft 6*a* to the outer peripheral surface of the eccentric cam 6 is shortest. Furthermore, a rotary shaft of the second transfer roller T2*b* is set to continuously approach the backup roller T2*a* each time the eccentric cam 6 rotates from the position where the distance from the rotary shaft 6*a* to the outer peripheral surface of the eccentric cam 6 is shortest to the position where the distance from the rotary shaft 6*a* to the outer peripheral surface of the eccentric cam 6 is longest.

Raising-and-lowering mechanisms 1 to 6, M3, and SN2, each of which is an example of a contact-retract mechanism of a transfer member according to the exemplary embodiment, are formed of the components denoted by the reference numerals 1 to 6 and M3. Note that the raising-and-lowering mechanisms 1 to 6, M3, and SN2 are not limited to having the configurations described above as examples, and the configurations of the raising-and-lowering mechanisms 1 to 6, M3, and SN2 may be changed to, for example, various known configurations described in Japanese Unexamined Patent Application Publication No. 2015-25920 and the like.

Accordingly, the raising-and-lowering mechanisms 1 to 6 and M3 enable the second transfer roller T2*b* according to the exemplary embodiment to move in directions toward and away from the intermediate transfer belt B. Therefore, the second transfer roller T2*b* according to the exemplary embodiment is capable of moving between the contact position indicated by a solid line in FIG. 1 where the second transfer roller T2*b* is in contact with the intermediate transfer belt B and the retract position indicated by a dashed line in FIG. 1 where the second transfer roller T2*b* is separated from the intermediate transfer belt B.

In FIG. 2, the end portions of the backup roller T2*a* are rotatably supported by second raising-and-lowering plates 11, each of which is an example of a movable member. The second raising-and-lowering plates 11 are supported on the frame body of the printer body U1 so as to be rotatable about a rotary shaft 11*a*. A second cam follower 12, which is an example of a contact portion, is supported on one of the second raising-and-lowering plates 11 so to be disposed on the left-hand side of the rotary shaft 11*a*. The second cam follower 12 is formed in a plate-like shape projecting outward in the axial direction of the backup roller T2*a*. One of second eccentric cams 13, each of which is an example of a pressing-force correction member, is disposed above the second cam follower 12. The second eccentric cams 13 are supported so as to be rotatable about a rotary shaft 13*a*. The rotary shaft 13*a* is capable of receiving a driving force transmitted from a deviation correction motor M4*a*, which is an example of a driving source. Note that, in the exemplary embodiment, the deviation correction motor M4*a* and a deviation correction motor M4*b*, which is different from the deviation correction motor M4*a*, are configured to be capable of transmitting driving forces independently of each other to the front second eccentric cam 13 and the rear second eccentric cam 13 (not illustrated), respectively.

Press-contact-degree correction mechanisms 11 to 13, M4*a*, and M4*b*, each of which is an example of a pressing-force correction mechanism, are formed of the components denoted by the reference numerals 11 to 13, M4*a*, and M4*b*.

Accordingly, the press-contact-degree correction mechanisms 11 to 13, M4*a*, and M4*b* enable a first end portion or a second end portion of the backup roller T2*a* according to the exemplary embodiment in the axial direction of the backup roller T2*a* to move in a direction toward the second transfer roller T2*b*, that is, in a direction in which the first end portion or the second end portion is pressed into contact with the second transfer roller T2*b*.

(Description of Fixing Device F)

In the fixing device F according to the exemplary embodiment, the heating roller Fh, which is an example of a first transport member and an example of a first fixing member, and the pressure roller Fp, which is an example of a second fixing member, are capable of moving into and out of contact with each other. In the fixing device F according to the exemplary embodiment, the pressure roller Fp is capable of moving between a contact position indicated by a solid line in FIG. 1 where the pressure roller Fp is in contact with the heating roller Fh and a retract position indicated by a dashed line in FIG. 1 where the pressure roller Fp is separated from the heating roller Fh.

Note that the raising-and-lowering mechanism of the second transfer roller T2*b* illustrated in FIG. 2 may be used in a configuration that causes the heating roller Fh and the pressure roller Fp to move into and out of contact with each other. Alternatively, for example, the mechanism described in Japanese Unexamined Patent Application Publication No. 2008-185638 that changes the pressure in a fixing region may be applied to the configuration that causes the heating roller Fh and the pressure roller Fp to move into and out of contact with each other. Alternatively, various known configurations, such as the technologies described in Japanese Unexamined Patent Application Publication No. 2015-25920 and the like, may be employed. Therefore, illustration and detailed description of the mechanism that causes the heating roller Fh and the pressure roller Fp to move into and out of contact with each other will be omitted.

(Description of Deviation Sensing Member)

Figure 3:
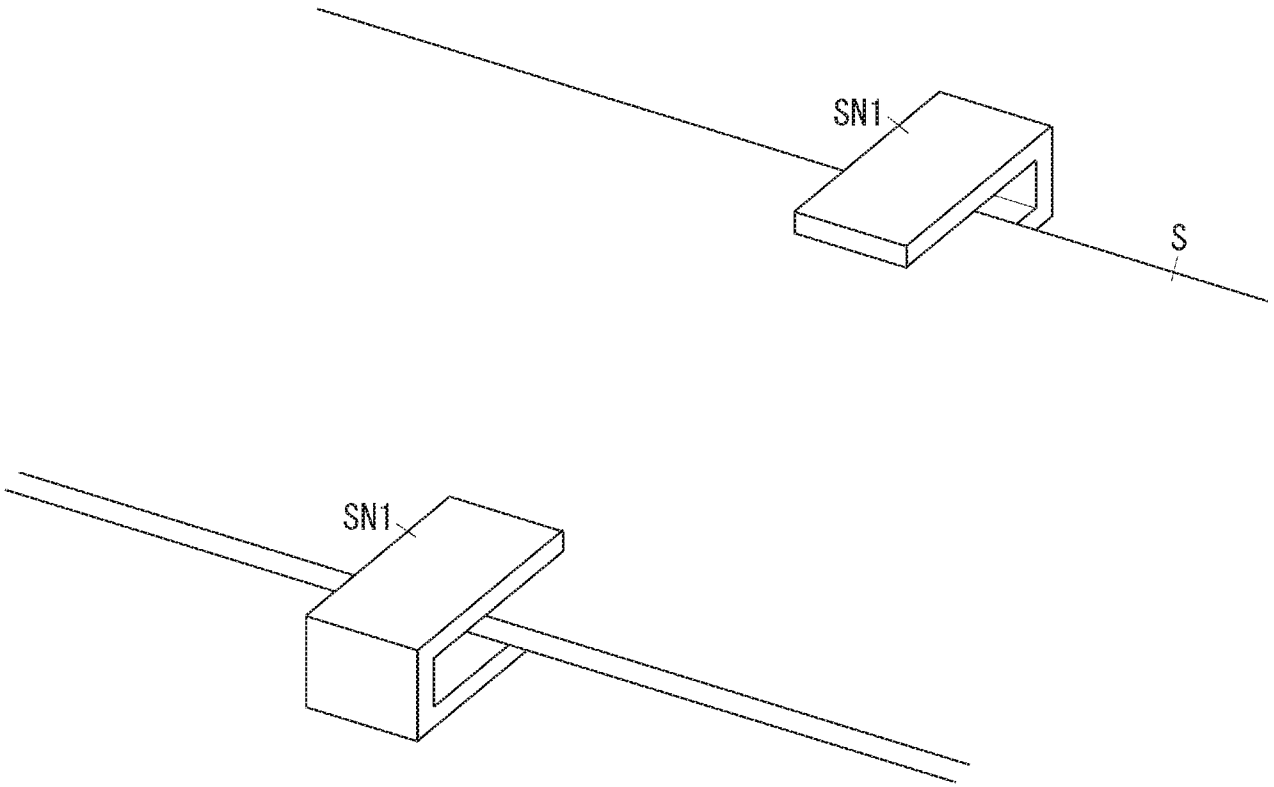
FIG. 3 is a diagram illustrating a deviation sensing member according to the exemplary embodiment.

FIG. 3 is a diagram illustrating a deviation sensing member according to the exemplary embodiment.

In FIG. 3, in the printer U according to the exemplary embodiment, skew sensors SN1, each of which is an example of a deviation sensing member, are disposed between the second transfer region Q4 and the fixing region Q5. The skew sensors SN1 according to the exemplary embodiment are disposed at the ends of the continuous sheet S in the width direction of the continuous sheet S. As an example, each of the skew sensors SN1 according to the exemplary embodiment is formed of a light sensor arranged in such a manner that the continuous sheet S is interposed between the portions of the light sensor in the thickness direction of the continuous sheet S. Thus, in the case where both the skew sensors SN1 at the ends in the width direction do not detect the continuous sheet S, it may be determined that the continuous sheet S is moving within a predetermined range. In the case where one of the skew sensors SN1 in the width direction detects the continuous sheet S, it may be determined that the continuous sheet S is moving while deviating toward the skew sensor SN1 that has detected the continuous sheet S; that is, the continuous sheet S is skewed.

(Description of Pull Roller R11)

A torque limiter TL, which is an example of a driving-force limiting member, is provided in a drive transmission system including the pull roller R11, which is an example of a second transport member according to the exemplary embodiment, and a pull-roller drive motor M5, which is an example of a driving source. When a load applied to the pull roller R11 reaches a predetermined load along with an increase in the tension exerted on the continuous sheet S when the pull roller R11 transports the continuous sheet S, the torque limiter TL limits a driving force that is transmitted to the pull roller R11. In other words, in the case where the load applied to the pull roller R11 does not reach the predetermined load, the torque limiter TL does not operate, and the driving force of the pull-roller drive motor M5 is transmitted to the pull roller R11.

(Description of Controller According to Exemplary Embodiment)

Figure 4:
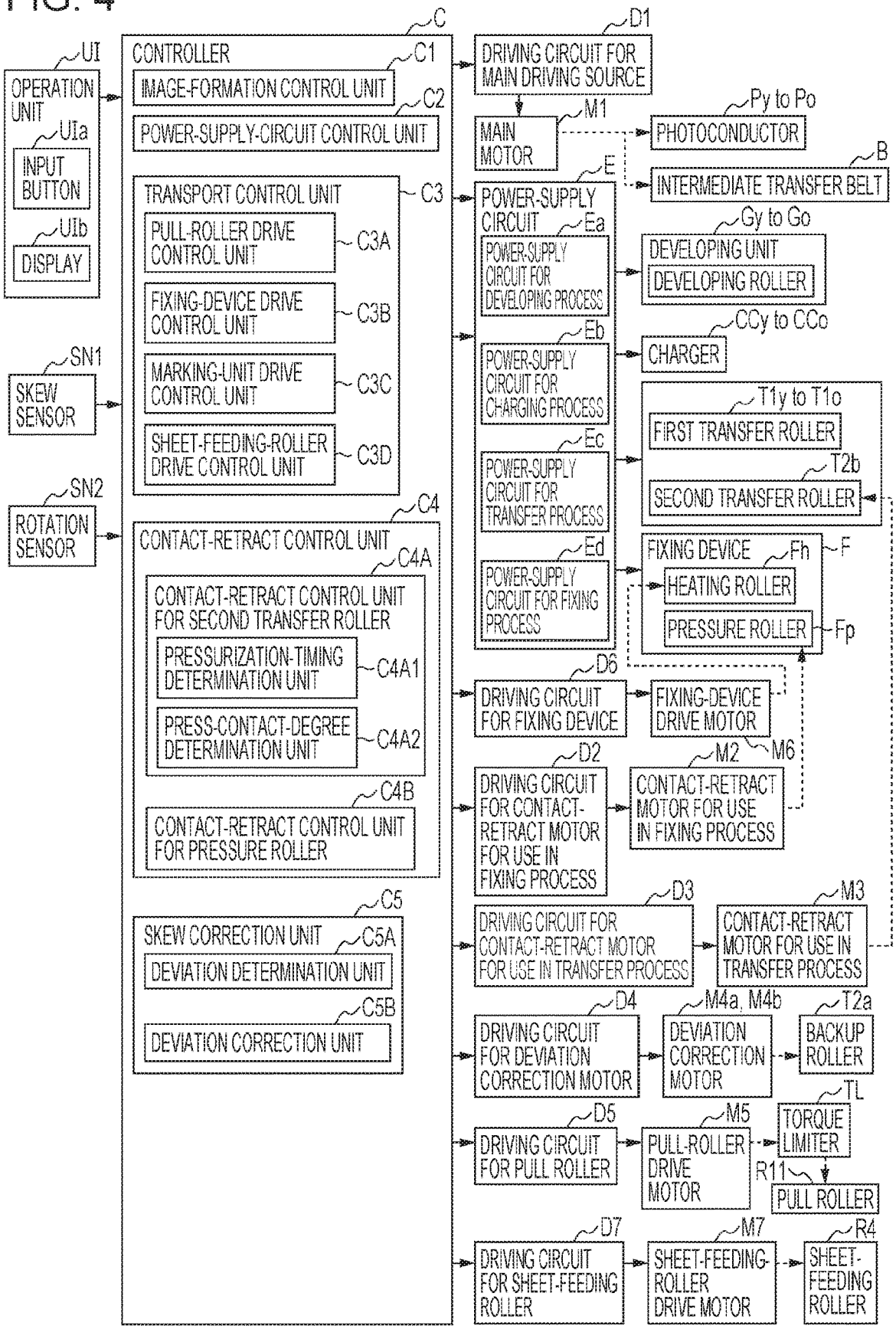
FIG. 4 is a block diagram illustrating functions of a controller included in the image forming apparatus according to the exemplary embodiment.

FIG. 4 is a block diagram illustrating functions of the controller included in the image forming apparatus according to the exemplary embodiment.

In FIG. 4, the controller C of the printer U includes an input/output interface I/O. For example, the input/output interface I/O inputs and outputs signals to and from the outside. The controller C further includes a read only memory (ROM) that stores programs for processing to be performed, information, and the like. The controller C further includes a random access memory (RAM) that temporarily stores necessary data. The controller C further includes a central processing unit (CPU) that performs processing according to programs stored in the ROM and the like. Accordingly, the controller C according to the exemplary embodiment is formed of a small-sized information processing apparatus, or specifically a microcomputer. Thus, the controller C may realize various functions by executing the programs stored in the ROM and the like.

(Signal-Output Elements Connected to Controller C)

Output signals from signal-output elements, such as an operation unit UI, the skew sensors SN1, and the rotation sensor SN2, are input to the controller C.

The operation unit UI has input buttons UIa including arrow buttons and a numeric keypad, each of which is an example of an input unit and each of which is used for an input operation. The operation unit UI further includes a display UIb, which is an example of a notification unit.

The skew sensors SN1 detect skewing of the continuous sheet S.

The rotation sensor SN2 measures the rotation positions of the eccentric cams 6.

(To-be-Controlled Element Connected to Controller C)

The controller C is connected to a driving circuit D1 for a main driving source, a driving circuit D2 for a contact-retract motor for use in a fixing process, a driving circuit D3 for a contact-retract motor for use in a transfer process, a driving circuit D4 for a deviation correction motor, a driving circuit D5 for a pull roller, a driving circuit D6 for a fixing device, a driving circuit D7 for a sheet-feeding roller, a power-supply circuit E, and other control elements (not illustrated). The controller C outputs control signals for the circuits D1 to D7 and E and the like to the circuits D1 to D7 and E and the like.

D1: Driving Circuit for Main Driving Source

The photoconductors Py to Po, the intermediate transfer belt B, and the like are driven so as to rotate by the circuit D1 via a main motor M1, which is an example of a driving source for an image carrier and an example of a main driving source.

D2: Driving Circuit for Contact-Retract Motor for Use in Fixing Process

The circuit D2 drives a contact-retract motor M2 for use in a fixing process so as to cause the pressure roller Fp to move into and out of contact with the heating roller Fh.

D3: Driving Circuit for Contact-Retract Motor for Use in Transfer Process

The circuit D3 drives the contact-retract motor M3 for use in a transfer process so as to cause the second transfer roller T2*b* to move into and out of contact with the continuous sheet S.

D4: Driving Circuit for Deviation Correction Motor

The circuit D4 drives the deviation correction motors M4*a* and M4*b* so as to cause the backup roller T2*a* to move in directions toward and away from the second transfer roller T2*b*.

D5: Driving Circuit for Pull Roller

The circuit D5 drives the pull-roller drive motor M5 so as to cause, via the torque limiter TL, the pull roller R11 to rotate.

D6: Driving Circuit for Fixing Device

The circuit D6 drives a fixing-device drive motor M6 so as to cause the heating roller Fh of the fixing device F to rotate.

D7: Driving Circuit for Sheet-Feeding Roller

The circuit D7 drives a sheet-feeding-roller drive motor M7 so as to cause the sheet-feeding roller R4 to rotate.

E: Power-Supply Circuit

The power-supply circuit E includes a power-supply circuit Ea for use in a developing process, a power-supply circuit Eb for use in a charging process, a power-supply circuit Ec for use in a transfer process, and a power-supply circuit Ed for use in a fixing process.

Ea: Power-Supply Circuit for Use in Developing Process

The power-supply circuit Ea for use in a developing process applies a developing voltage to developing rollers of the developing units Gy to Go.

Eb: Power-Supply Circuit for Use in Charging Process

The power-supply circuit Eb for use in a charging process applies a charging voltage for charging the surfaces of the photoconductors Py to Po to the chargers CCy to CCo.

Ec: Power-Supply Circuit for Use in Transfer Process

The power-supply circuit Ec for use in a transfer process applies a transfer voltage to the first transfer rollers T1*y* to T1*o* and the contact roller T2*c*.

Ed: Power-Supply Circuit for Use in Fixing Process

The power-supply circuit Ed for use in a fixing process supplies power to a built-in heater of the heating roller Fh of the fixing device F.

(Functions of Controller C)

The controller C has a function of outputting control signals to the control elements by performing processing according to input signals from the signal-output elements. In other words, the controller C has the following functions.

C1: Image-Formation Control Unit

An image-formation control unit C1 controls, for example, driving of the members included in the printer U and the timing of application of voltages to the members in accordance with image information input from the print-image server COM in such a manner as to control execution, termination, and suspension of a job, which is an image forming operation.

C2: Power-Supply-Circuit Control Unit

A power-supply-circuit control unit C2 controls the power-supply circuits Ea to Ed so as to control the voltages to be applied to the members and the power to be supplied to the members.

Figure 5:
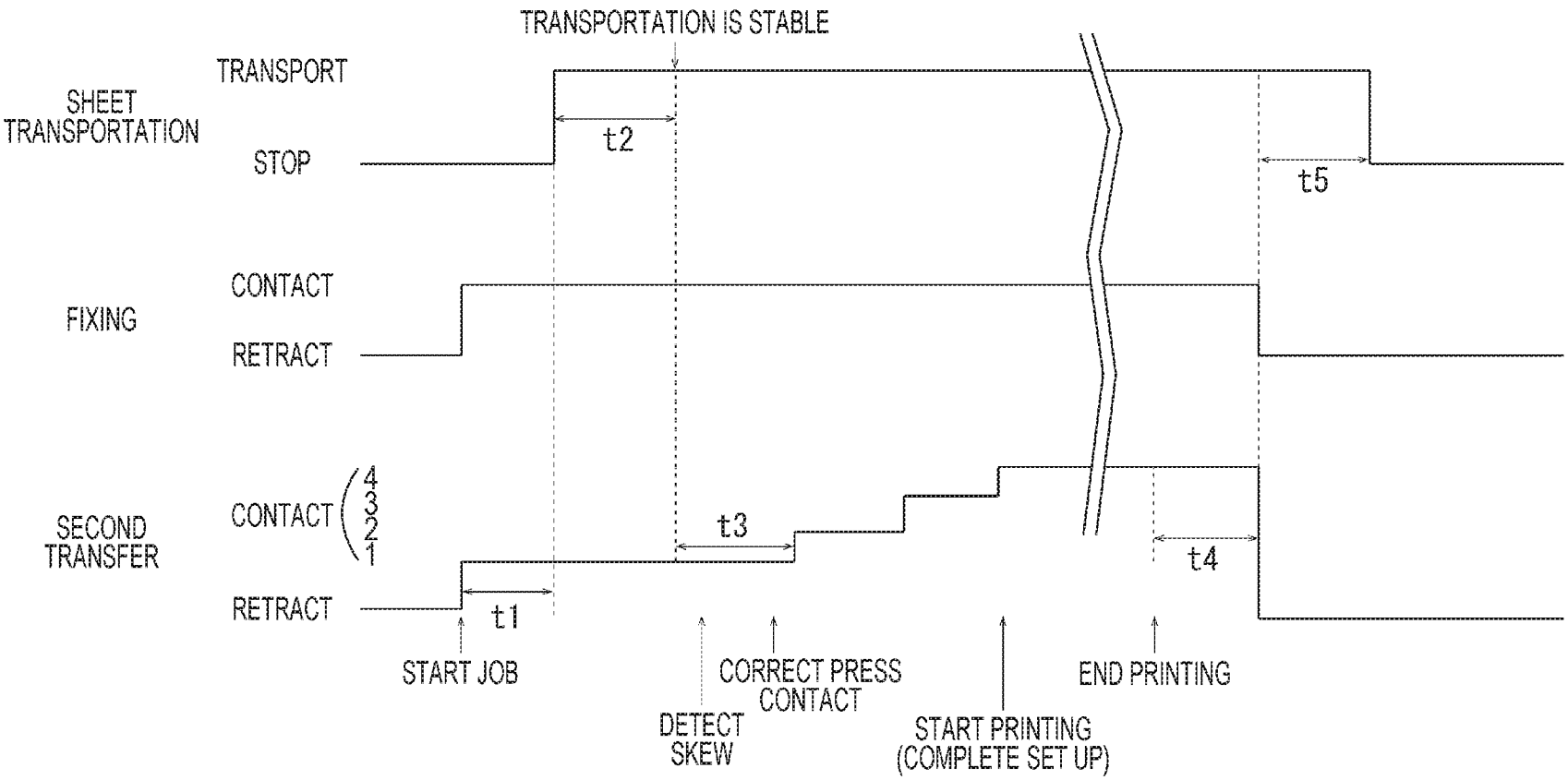
FIG. 5 is a time chart illustrating transportation of a medium and contacting and retracting in a fixing region and in a second transfer region according to the exemplary embodiment and is a time chart in which the horizontal axis represents time.

FIG. 5 is a time chart illustrating transportation of a medium and contacting and retracting in the fixing region and in the second transfer region according to the exemplary embodiment and is a time chart in which the horizontal axis represents time.

C3: Transport Control Unit

A transport control unit C3 includes a pull-roller drive control unit C3A, a fixing-device drive control unit C3B, a marking-unit drive control unit C3C, and a sheet-feeding-roller drive control unit C3D. The transport control unit C3 controls transportation of the continuous sheet S. In FIG. 5, the transport control unit C3 according to the exemplary embodiment performs control in such a manner that the transportation of the continuous sheet S is started when a predetermined transportation period t1 has passed after a job has been started. In addition, the transport control unit C3 performs control in such a manner that the transportation of the continuous sheet S is discontinued when a predetermined discontinuing period t5 has passed after printing of the last page has been completed and after the second transfer roller T2*b* and the pressure roller Fp have been moved to the corresponding retract positions.

Figure 6:
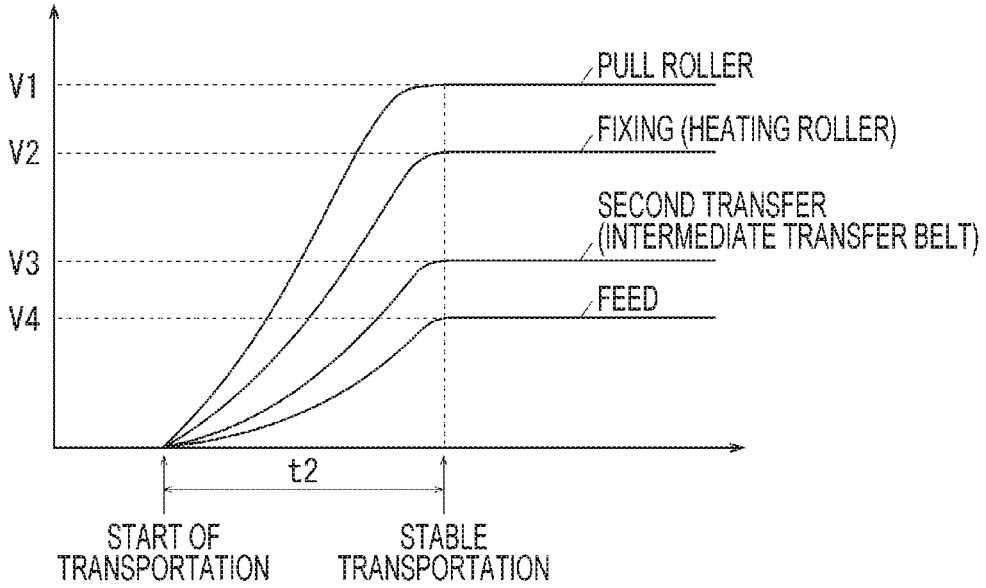
FIG. 6 is a graph illustrating the speed at which a continuous sheet is transported according to the exemplary embodiment and is a graph in which the horizontal axis represents time and the vertical axis represents speed.

FIG. 6 is a graph illustrating the speed at which the continuous sheet according to the exemplary embodiment is transported and is a graph in which the horizontal axis represents time and the vertical axis represents speed.

C3A: Pull-Roller Drive Control Unit

The pull-roller drive control unit C3A, which is an example of a drive control unit for a transport member, controls starting and stopping of driving of the pull roller R11 via the circuit D5. As illustrated in FIG. 6, the pull-roller drive control unit C3A according to the exemplary embodiment performs control in such a manner that the transport speed of the pull roller R11 is increased, at a predetermined acceleration, to a pull-roller transport speed V1 once the driving of the pull roller R11 has been started. In FIG. 5 and FIG. 6, in the exemplary embodiment, the pull-roller drive control unit C3A performs control in such a manner that the transport speed of the pull roller R11 reaches the pull-roller transport speed V1 when a predetermined stabilization period t2 has elapsed since the start of the driving of the pull roller R11. Note that the pull-roller drive control unit C3A according to the exemplary embodiment performs control in such a manner that, when the driving of the pull roller R11 is stopped, the transport speed of the pull roller R11 is decreased at a deceleration substantially the same as the acceleration when the driving of the pull roller R11 is started. In the exemplary embodiment, as an example, the pull-roller transport speed V1 is set to be 2% higher than a marking-unit transport speed V3.

C3B: Fixing-Device Drive Control Unit

The fixing-device drive control unit C3B, which is an example of a drive control unit for a transport member, controls starting and stopping of driving of the heating roller Fh via the circuit D6. As illustrated in FIG. 6, the fixing-device drive control unit C3B according to the exemplary embodiment performs control in such a manner that the transport speed of the heating roller Fh is increased, at an acceleration smaller than the acceleration of the pull roller R11, to a fixing-device transport speed V2 once the driving of the heating roller Fh has been started. The fixing-device drive control unit C3B performs control in such a manner that, when the driving of the fixing device F is stopped, the transport speed of the heating roller Fh is decreased at a deceleration the same as the acceleration when the transport speed of the heating roller Fh is increased. In the exemplary embodiment, the fixing-device transport speed V2 is set to be lower than the pull-roller transport speed V1.

C3C: Marking-Unit Drive Control Unit

The marking-unit drive control unit C3C, which is an example of a drive control unit for a transfer member, controls driving of the main motor M1 via the circuit D1 and controls driving of the photoconductors Py to Po, driving of the intermediate transfer belt B, and the like. As illustrated in FIG. 6, the marking-unit drive control unit C3C according to the exemplary embodiment performs control in such a manner that the transport speeds of the intermediate transfer belt B and the like are increased, at an acceleration smaller than the acceleration of the heating roller Fh, to the marking-unit transport speed V3 once the driving of the intermediate transfer belt B and the like has been started. The marking-unit drive control unit C3C performs control in such a manner that, when the driving of the marking unit U1*a* is stopped, the transport speeds of the intermediate transfer belt B and the like are decreased at a deceleration the same as the acceleration when the transport speeds of the intermediate transfer belt B and the like are increased. In the exemplary embodiment, the marking-unit transport speed V3 is set to be lower than the fixing-device transport speed V2. In the exemplary embodiment, as an example, the fixing-device transport speed V2 is set to be 0.98% higher than the marking-unit transport speed V3.

C3D: Sheet-Feeding-Roller Drive Control Unit

The sheet-feeding-roller drive control unit C3D, which is an example of a drive control unit for a transport member, controls driving of the sheet-feeding-roller drive motor M7 via the circuit D7 and controls driving of the sheet-feeding roller R4. As illustrated in FIG. 6, the sheet-feeding-roller drive control unit C3D according to the exemplary embodiment performs control in such a manner that the transport speed of the sheet-feeding roller R4 is increased, at an acceleration smaller than the acceleration of the intermediate transfer belt B and the like, to a sheet-feeding-roller transport speed V4 once the driving of the sheet-feeding roller R4 has been started. The sheet-feeding-roller drive control unit C3D performs control in such a manner that, when the driving of the sheet-feeding roller R4 is stopped, the transport speed of the sheet-feeding roller R4 is decreased at a deceleration the same as the acceleration when the transport speed of the sheet-feeding roller R4 is increased. In the exemplary embodiment, the sheet-feeding-roller transport speed V4 is set to be lower than the marking-unit transport speed V3. In the exemplary embodiment, as an example, the sheet-feeding-roller transport speed V4 is set to be 0.2% lower than the marking-unit transport speed V3.

C4: Contact-Retract Control Unit

A contact-retract control unit C4 includes a contact-retract control unit C4A for a second transfer roller and a contact-retract control unit C4B for a pressure roller. When a job is started, and when the job is ended, the contact-retract control unit C4 causes the second transfer roller T2*b* and the pressure roller Fp to move to the corresponding contact positions or the corresponding retract positions.

C4A: Contact-Retract Control Unit for Second Transfer Roller

The contact-retract control unit C4A includes a pressurization-timing determination unit C4A1 and a press-contact-degree determination unit C4A2. The contact-retract control unit C4A causes, via the circuit D3, the second transfer roller T2*b* to move between the contact position and the retract position. When a job is started, the contact-retract control unit C4A according to the exemplary embodiment controls the eccentric cams 6 so as to cause the second transfer roller T2*b* to move toward the contact position.

In this case, when the contact-retract control unit C4A according to the exemplary embodiment moves the second transfer roller T2*b* to an approach position, the contact-retract control unit C4A causes the second transfer roller T2*b* to move to the approach position in four stages by rotating the eccentric cams 6 by, for example, 45 degrees for each stage on the basis of detection results obtained by the rotation sensor SN2. Thus, in the second transfer region Q4, the distance between the axis of the backup roller T2*a* and the axis of the second transfer roller T2*b* decreases in four stages. Accordingly, a design press-contact degree of the second transfer roller T2*b* in the second transfer region Q4 increases in four stages. Consequently, in the exemplary embodiment, the pressing force applied to the second transfer roller T2*b* against the continuous sheet S is increased in four stages. Note that the second transfer roller T2*b* according to the exemplary embodiment is set to be come into contact with the continuous sheet S by a small pressing force once the eccentric cams 6 have rotated by 45 degrees. In FIG. 5, the contact-retract control unit C4A according to the exemplary embodiment performs control in such a manner that the eccentric cams 6 rotate by 45 degrees when a job is started and rotate by another 45 degrees each time a predetermined pressing time t3 has elapsed since transport operations performed by the pull roller R11 and the like have been stabilized. In addition, when the job is ended, the contact-retract control unit C4A according to the exemplary embodiment performs control in such a manner that the second transfer roller T2*b* moves to the retract position after a predetermined retracting time t4 has elapsed since the last page has been printed.

C4A1: Pressurization-Timing Determination Unit

The pressurization-timing determination unit C4A1 determines whether a pressurization timing at which the pressing force of the second transfer roller T2*b* is increased has arrived. The pressurization-timing determination unit C4A1 according to the exemplary embodiment determines that the pressurization timing has arrived when a job is started and each time the pressing time t3 has elapsed after the stabilization period t2 has passed.

C4A2: Press-Contact-Degree Determination Unit

The press-contact-degree determination unit C4A2 determines whether the press-contact degree of the second transfer roller T2*b* is largest, that is, whether the second transfer roller T2*b* has moved to the approach position. In the exemplary embodiment, the rotation positions of the eccentric cams 6 are detected on the basis of the detection results obtained by the rotation sensor SN2 so as to determine whether the second transfer roller T2*b* has moved to the approach position.

C4B: Contact-Retract Control Unit for Pressure Roller

A contact-retract control unit C4B for a pressure roller causes, via the circuit D2, the pressure roller Fp to move into and out of contact with the heating roller Fh and the continuous sheet S. The contact-retract control unit C4B according to the exemplary embodiment causes the pressure roller Fp to perform contacting and retracting movements in accordance with the timings at which the second transfer roller T2*b* performs contacting and retracting movements.

C5: Skew Correction Unit

A skew correction unit C5 includes a deviation determination unit C5A and a deviation correction unit C5B. The skew correction unit C5 corrects skewing of the continuous sheet S.

C5A: Deviation Determination Unit

Before the speed at which the continuous sheet S is transported reaches a predetermined speed, the deviation determination unit C5A determines deviation of the continuous sheet S in the width direction of the continuous sheet S on the basis of detection results obtained by the skew sensors SN1. The deviation determination unit C5A according to the exemplary embodiment determines, on the basis of the detection results obtained by the skew sensors SN1, that the continuous sheet S has deviated to a first end side or to a second end side in the width direction or that there is no deviation of the continuous sheet S.

C5B: Deviation Correction Unit

The deviation correction unit C5B corrects, on the basis of the determination result related to deviation of the continuous sheet S obtained by the deviation determination unit C5A, the pressing force at the first end and the pressing force at the second end of the second transfer roller T2*b* in the axial direction in such a manner as to reduce the deviation. The deviation correction unit C5B according to the exemplary embodiment corrects the pressing force at the first end and the pressing force at the second end of the second transfer roller T2*b* in the axial direction by correcting the positions of the ends of the backup roller T2*a* via the circuit D4. More specifically, in the case where the continuous sheet S is skewed to the first end side (the front side) in the width direction, the deviation correction unit C5B according to the exemplary embodiment controls the deviation correction motor M4*b* located on the second end side (the back side) so as to move the second end portion (portion on the back side) of the backup roller T2*a* downward. In other words, when the amount of elastic deformation of the rollers T2*a* and T2*b* on the second end side is increased by increasing the press-contact degree of the backup roller T2*a*, the radiuses of the rollers T2*a* and T2*b* are smaller than those on the first end side. Consequently, the peripheral speeds of the rollers T2*a* and T2*b* on the second end side are lower than those on the first end side, and the continuous sheet S receives a force that causes the continuous sheet S to deviate to the second end side. As a result, the skewing is corrected, that is, the deviation of the continuous sheet S is reduced.

(Description of Flowchart According to Exemplary Embodiment)

The flow of control in the printer U according to the exemplary embodiment will now be described by using a flowchart.

(Description of Flowchart of Processing for Controlling Transportation of Continuous Sheet)

Figure 7:
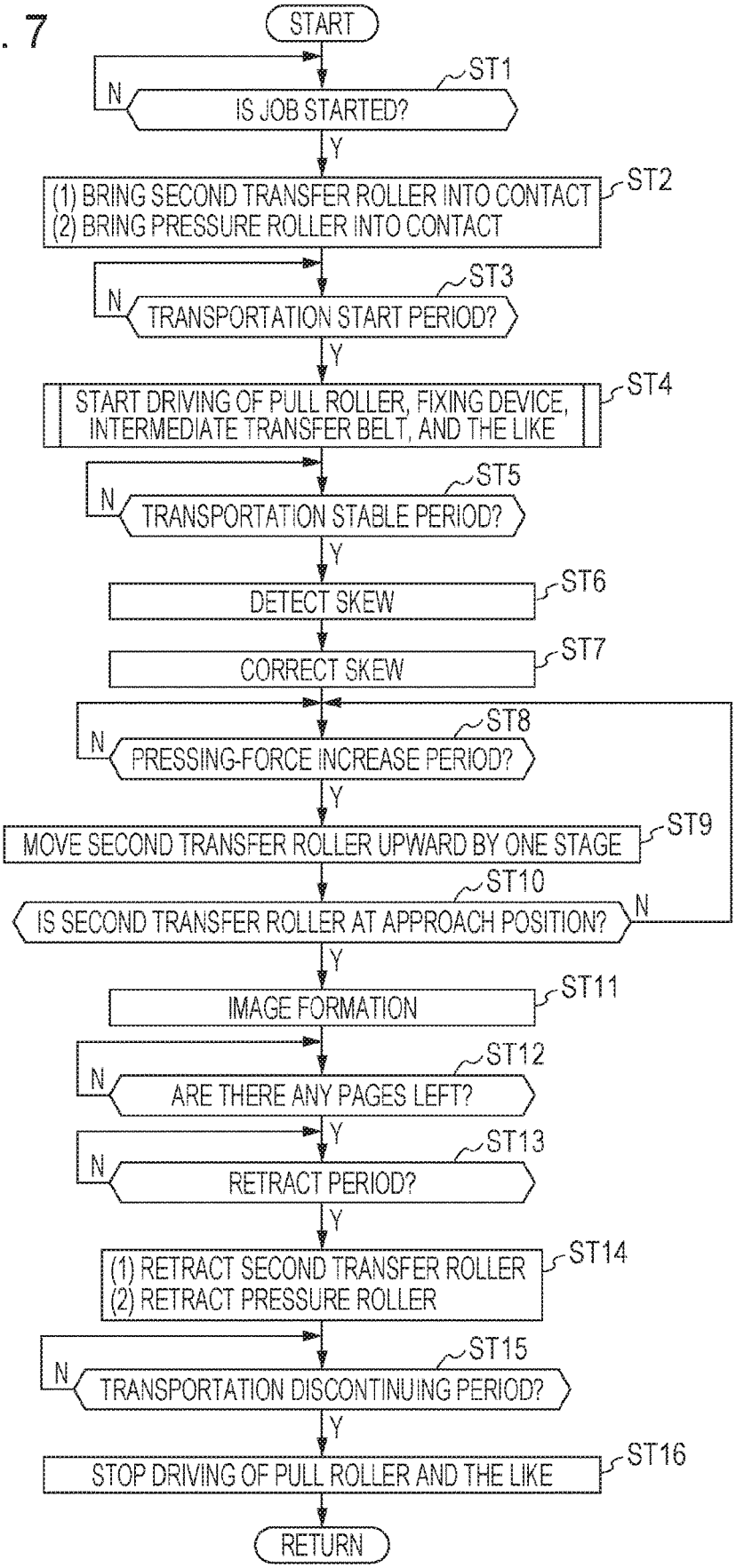
FIG. 7 is a flowchart of processing for controlling transportation of the continuous sheet according to the exemplary embodiment.

FIG. 7 is a flowchart of processing for controlling transportation of the continuous sheet S according to the exemplary embodiment.

The processes of steps ST in the flowchart illustrated in FIG. 7 are executed in accordance with programs stored in the controller C of the printer U. In addition, these processes are executed in parallel with other various processes of the printer U.

The flowchart illustrated in FIG. 7 is started once the printer U has been switched on.

In ST1 of FIG. 7, it is determined whether a job has been started. In the case where the determination result is Yes (Y), the processing continues to ST2, and in the case where the determination result is No (N), ST1 is repeated.

In ST2, the following processes (1) and (2) are executed, and the processing continues to ST3.

(1) The second transfer roller T2*b* is moved by one stage toward the corresponding contact position.

(2) The pressure roller Fp is moved to the corresponding contact position.

In ST3, it is determined whether the transportation starting period t1 has arrived. In the case where the determination result is Yes (Y), the processing continues to ST4, and in the case where the determination result is No (N), ST3 is repeated.

In ST4, driving of the pull roller R11, the fixing device F, the intermediate transfer belt B, and the sheet-feeding roller R4 is started. Then, the processing continues to ST5.

In ST 5, it is determined whether the transportation stabilization period t2 has arrived. In the case where the determination result is Yes (Y), the processing continues to ST6, and in the case where the determination result is No (N), ST5 is repeated.

In ST6, skewing of the continuous sheet S is detected. Then, the processing continues to ST7.

In ST7, the first end or the second end of the backup roller T2*a* is moved in accordance with the skewing of the continuous sheet S such that the skewing is corrected. Then, the processing continues to ST8.

In ST8, it is determined whether the pressurization timing has arrived. In other words, it is determined whether the pressing time t3 has elapsed. In the case where the determination result is Yes (Y), the processing continues to ST9, and in the case where the determination result is No (N), ST8 is repeated.

In ST9, the second transfer roller T2*b* is moved by one stage toward the approach position. Then, the processing continues to ST10.

In ST10, it is determined whether the second transfer roller T2*b* has moved to the approach position. In the case where the determination result is Yes (Y), the processing continues to ST11, and in the case where the determination result is No (N), ST8 is repeated.

In ST11, an image forming operation is performed. Then, the processing continues to ST12.

In ST12, it is determined whether there is another page having an image to be printed out. In the case where the determination result is Yes (Y), the processing continues to ST13, and in the case where the determination result is No (N), ST12 is repeated.

In ST13, it is determined whether the retracting time t4 for the rollers T2*b* and Fp has arrived. In the case where the determination result is Yes (Y), the processing continues to ST14, and in the case where the determination result is No (N), ST13 is repeated.

In ST14, the following processes (1) and (2) are executed, and the processing continues to ST15.

(1) The second transfer roller T2*b* is moved to the corresponding retract position.

(2) The pressure roller Fp is moved to the corresponding retract position.

In ST15, it is determined whether the transportation discontinuing period t5 has arrived. In the case where the determination result is Yes (Y), the processing continues to ST16, and in the case where the determination result is No (N), ST15 is repeated.

In ST16, driving of the pull roller R11 and the like is stopped. Then, the processing returns to ST 1.

Effects of Exemplary Embodiment

In the printer U according to the exemplary embodiment, which has the above-described configuration, before a job is started, the second transfer roller T2*b* and the pressure roller Fp are moved to the corresponding retract positions. Thus, the probability of breakage of the continuous sheet S, which is not being transported, is reduced. Examples of such breakage include the curl of the continuous sheet S generated as a result of the continuous sheet S being pressurized in the second transfer region Q4 or in the fixing region Q5 and thermal deformation of the continuous sheet S occurred as a result of the continuous sheet S receiving heat from the heating roller Fh, which has been heated.

Once a job has been started, the second transfer roller T2*b* and the pressure roller Fp move toward the corresponding contact positions. Then, driving of the pull roller R11, the heating roller Fh, the intermediate transfer belt B, and the sheet-feeding roller R4 is started. In the exemplary embodiment, both when the transport speeds of the transport members are accelerated and when the transport operations performed by the transport members are stabilized, the transport members R11, Fh, and B, which are disposed on the downstream side in the transport direction of the continuous sheet S, transport the continuous sheet S at a speed higher than the speed at which the transport members Fh, B, and R4, which are disposed on the upstream side, transport the continuous sheet S. That is to say, tension is exerted on the continuous sheet S. Thus, the probability that the continuous sheet S will be slackened is reduced. In the case where the continuous sheet S is transported in a state of being slackened, tension is not exerted on a portion of the continuous sheet S, the portion being slackened, and thus, it is difficult to control the position of the continuous sheet S. Consequently, there is a problem in that the continuous sheet S sustains damage or is contaminated by making contact with an unexpected object. In addition, there is a case where, when the slackened portion enters a region such as the second transfer region Q4 or the fixing region Q5 in which the continuous sheet S is to be nipped between rollers, wrinkles are likely to be generated in the continuous sheet S. In contrast, in the exemplary embodiment, the probability that the continuous sheet S will be slackened is reduced, and contamination of the continuous sheet S and generation of wrinkles in the continuous sheet S is suppressed, whereas if the continuous sheet S is transported in a state of being slackened, contamination of the continuous sheet S and generation of wrinkles in the continuous sheet S will not be suppressed.

If the second transfer roller T2*b* and the pressure roller Fp, which are stationary, respectively come into contact with the transport member B and the transport member Fh during the period when the transport members R11, Fh, B, and R4 are rotating at the transport speeds V1 to V4, respectively, there will be a large difference in speed. Consequently, abrasions may sometimes occur on the continuous sheet S, the second transfer roller T2*b*, and the pressure roller Fp. In contrast, in the exemplary embodiment, the transport members R11, Fh, B, and R4 are driven in a state where the second transfer roller T2*b* and the pressure roller Fp are in contact with the transport member B and the transport member Fh, respectively. Therefore, the probability of the occurrence of abrasions on the continuous sheet S, the second transfer roller T2*b*, and the like is reduced, whereas if the second transfer roller T2*b* comes into contact with the transport member B after the transport members R11, Fh, B, and R4 have started rotating, the probability of the occurrence of abrasion will not be reduced.

Note that, in the exemplary embodiment, also when stopping the driving of the transport members, the transport members are stopped while the transport members R11, Fh, B, and R4 located on the downstream side are rotating at higher speed. Therefore, the probability that the continuous sheet S will be slackened is reduced, and it is unlikely that the next transportation is started in a state where the continuous sheet S is slackened.

Note that, in the exemplary embodiment, the pull roller R11 is provided with the torque limiter TL. Accordingly, when the tension that is exerted on the continuous sheet S as a result of the pull roller R11, which rotates at a speed higher than that at which the fixing device F rotates, pulling the continuous sheet S becomes excessively large, the pull roller R11 idles with respect to the motor M5. Thus, the probability that the continuous sheet S will be torn is reduced. Note that the contact pressure in the second transfer region Q4 and the contact pressure in the fixing region Q5 are set to be sufficiently larger than that of the pull roller R11 and that of the sheet-feeding roller R4. Consequently, in the second transfer region Q4 and the fixing region Q5, the probability that the continuous sheet S will slide along the intermediate transfer belt B and the fixing rollers Fh and Fp is reduced. Therefore, the probability of the occurrence of variations in image magnification at the time of a transfer process and the probability of the occurrence of a fixing failure are reduced.

In the exemplary embodiment, the second transfer roller T2*b* moves toward the approach position in a stepwise manner from the retract position, and a transfer operation (application of the transfer voltage) is started after the second transfer roller T2*b* has moved to the approach position. In the case where the second transfer roller T2*b* is moved to the approach position in one stroke, transport resistance is generated in the second transfer region Q4, in which the continuous sheet S is moving at a low speed, when the fixing device F is driven. Thus, there is a possibility that rotation of the fixing device F will become unstable when the fixing device F is driven as a result of a torque being applied thereto. In contrast, in the exemplary embodiment, the second transfer roller T2*b* moves to the approach position after rotations of the transport members R11, Fh, B, and R4 have become stable. Therefore, the transportation of the continuous sheet S is stabilized, whereas if the second transfer roller T2*b* is moved to the approach position at the start of transportation of the continuous sheet S, the transportation of the continuous sheet S will not be stabilized.

In the exemplary embodiment, the pressing force and the load of the second transfer roller T2*b* are increased in a stepwise manner. In the exemplary embodiment, if the second transfer roller T2*b* is moved from the position of the first stage to the position of the fourth stage in one stroke, the load will be markedly changed. Thus, unevenness in the load may sometimes occur between the first end and the second end of the second transfer roller T2*b* in the axial direction when the second transfer roller T2*b* moves to the approach position. As a result, the continuous sheet S may sometimes be skewed. In contrast, in the exemplary embodiment, the load of the second transfer roller T2*b* is increased in a stepwise manner, and each change in the load is smaller than that in the case where the second transfer roller T2*b* is moved to the approach position in one stroke. Therefore, the probability of the continuous sheet S being skewed is reduced.

In the exemplary embodiment, before the second transfer roller T2*b* reaches the approach position, skewing of the continuous sheet S is detected and corrected. When the second transfer roller T2*b* moves to the approach position, the pressure in the second transfer region Q4 is largest. Accordingly, as a result of the second transfer roller T2*b* being pressed, it is difficult to detect the positional deviation between the first end and the second end of the backup roller T2*a* and the positional deviation between the first end and the second end of the second transfer roller T2*b* in the axial direction, the positional deviations causing skewing. In contrast, in the exemplary embodiment, skewing of the continuous sheet S is detected before the second transfer roller T2*b* reaches the approach position, and deviation in the axial direction that causes the skewing may be easily detected. Therefore, the probability of the continuous sheet S being skewed is reduced.

Modifications of Exemplary Embodiment

Figure 8:
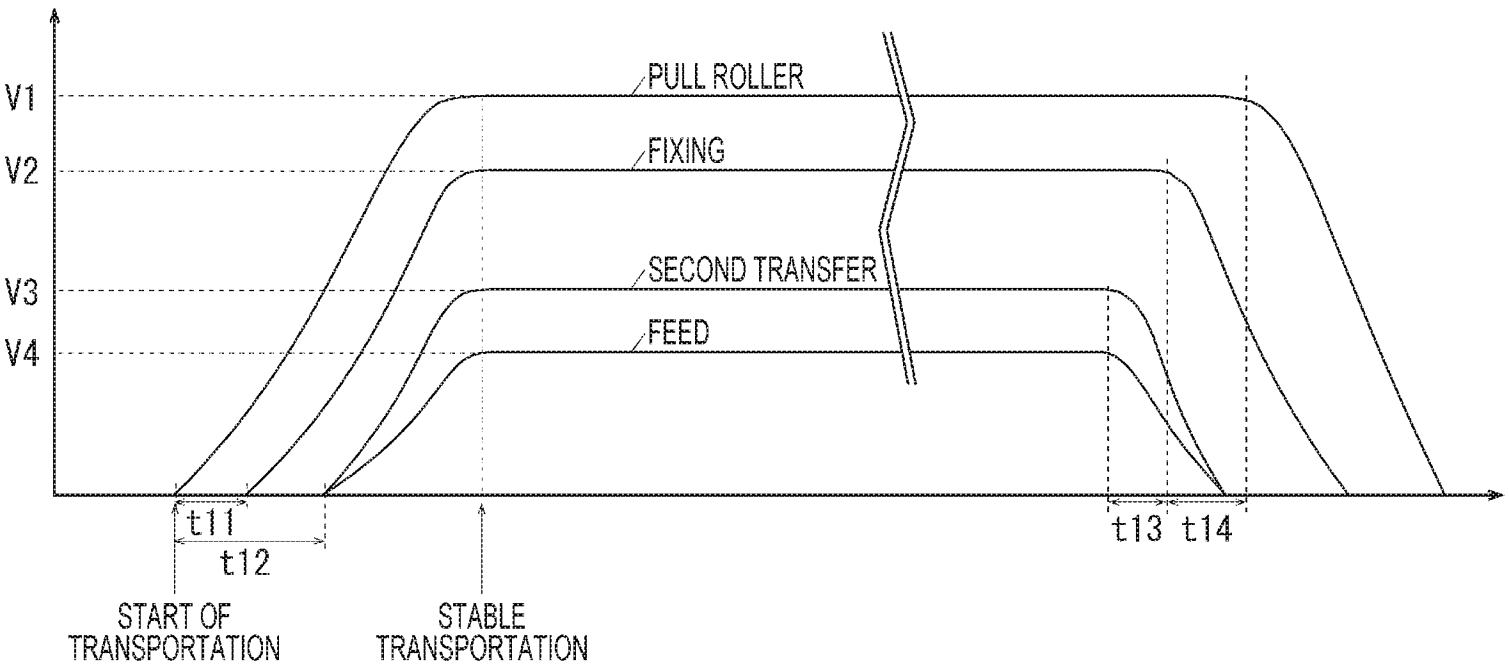
FIG. 8 is a graph illustrating a modification of the exemplary embodiment corresponding to FIG. 6 illustrating the exemplary embodiment.

FIG. 8 is a graph illustrating a modification of the exemplary embodiment corresponding to FIG. 6 illustrating the exemplary embodiment.

As illustrated in FIG. 6, in the exemplary embodiment, driving of the members R11, Fh, B, and R4, which transport the continuous sheet S, may be set such that the members R11, Fh, B, and R4 are driven at the same time. However, the present invention is not limited to this configuration. As illustrated in FIG. 8, the transport members R11, Fh, B, and R4 may be driven in this order starting from the downstream side, and when transportation of the continuous sheet S is stopped, the driving of the transport members R11, Fh, B, and R4 may be sequentially stopped starting from the upstream side. With the setting illustrated in FIG. 8, the rotation speed of each of the members R11, Fh, and B located on the downstream side may be kept higher than the rotation speed of each of the members Fh, B, and R4 located on the upstream side with certainty. In other words, even in the case where a speed acceleration profile at the time of starting driving of the members is unstable due to, for example, individual differences between the motors M1 and M5 to M7, the rotation speed of each of the members R11, Fh, and B located on the downstream side may be kept high.

(Modifications)

Although the exemplary embodiment of the present invention has been described in detail above, the present invention is not limited to the above-described exemplary embodiment, and various changes may be made within the scope of the present invention as described in the claims. Exemplary modifications (H01) to (H011) of the present invention will be described below.

(H01) In the above exemplary embodiment, although the printer U has been described as an example of an image forming apparatus, the image forming apparatus is not limited to the printer U and may be formed of, for example, a copying machine, a facsimile machine, or a multifunction machine that has some or all of the functions of such a copying machine and such a facsimile machine.

(H02) In the above-described exemplary embodiment, although the configuration of the printer U in which the developers of four colors are used has been described as an example, the present invention is not limited to this configuration, and the present invention may also be applied to, for example, an image forming apparatus that uses a developer of a single color and to an image forming apparatus that uses developers of three or less colors or five or more colors.

(H03) In the above-described exemplary embodiment, although the second transfer roller T2*b* having a roll-like shape has been described as an example of a transfer member, the transfer member is not limited to the second transfer roller T2*b*. For example, a configuration in which a belt is stretched also on the side on which a transfer roller is disposed may be employed, that is, a so-called transfer belt may be used. Note that, also in this case, members that oppose each other across a transfer region are a combination of a transfer roller and a backup roller. Similarly, although the intermediate transfer belt B having the form of a belt has been described as an example of an image carrier, the image carrier is not limited to the intermediate transfer belt B. A drum-shaped intermediate transfer body may be used. In addition, in the case of an image forming apparatus that uses a developer of a single color, an intermediate transfer body is not provided, and a transfer roller is capable of moving into and out of contact with a photoconductor, which is an example of an image carrier. The present invention may also be applied to such an image forming apparatus. Note that, in the case where a drum-shaped photoconductor or an intermediate transfer body is used, members that oppose each other with a medium interposed therebetween in a transfer region are a combination of the photoconductor and a transfer roller or a combination of the intermediate transfer body and a transfer roller. Then, the continuous sheet S is transported by a transfer device that includes the members opposing each other in the transfer region.

(H04) In the above-described exemplary embodiment, although the configuration in which the positions of the first end and the second end of the backup roller T2*a* in the axial direction are corrected has been described as an example of a skew-correction configuration, the skew-correction configuration is not limited to this configuration. A configuration in which the second transfer roller T2*b* is adjusted may be employed. In addition, although it is desirable that the skew-correction configuration be provided, the skew-correction configuration is not necessarily provided.

(H05) In the above-described exemplary embodiment, although the configuration in which the second transfer roller T2*b* is moved in four stages has been described as an example, the present invention is not limited to this configuration. The second transfer roller T2*b* may be moved in three or less stages or five or more stages. In addition, in the exemplary embodiment, although the configuration in which the pressing force of the second transfer roller T2*b* is increased in a stepwise manner has been described as an example, the present invention is not limited to this configuration. For example, a configuration in which the pressing force is continuously increased may be employed. In addition, when increasing the pressing force, changes may be made such that, for example, the increasing rate is set to be constant or the increasing rate is changed in the process of increasing the pressing force. Accordingly, the increasing rate may be set low at first and then increased. Alternatively, the increasing rate may be set high at first. Then, the increasing rate may be set to be zero for a certain period of time and then may be increased again.

(H06) In the above-described exemplary embodiment, although the case where the timing at which a job is started is set as the timing at which detection and correction of skewing are performed has been described as an example, the timing at which detection and correction of skewing are performed is not limited to the timing at which a job is started. The timing at which detection and correction of skewing are performed may be arbitrarily changed such that, for example, detection and correction of skewing are performed only when the printer U is switched on or when the second transfer device T2 is replaced. In addition, although it is desirable that detection and correction of skewing be performed in a state where the second transfer roller T2*b* has been moved toward the approach position by one stage, the present invention is not limited to this configuration. For example, detection and correction of skewing may be performed before the second transfer roller T2*b* reaches the approach position (the fourth stage), that is, for example, when the second transfer roller T2*b* moves to the second stage or the third stage.

(H07) In the above-described exemplary embodiment, although it is desirable that the pressure roller Fp move with movement of the second transfer roller T2*b*, the present invention is not limited to this configuration. A configuration in which the pressure roller Fp will not retract may be employed. Similarly, although it is desirable that, when transportation of the continuous sheet S is stopped, the second transfer roller T2*b* and the pressure roller Fp be separated from the intermediate transfer belt B and the heating roller Fh, respectively, the second transfer roller T2*b* and the pressure roller Fp may be in contact with the intermediate transfer belt B and the heating roller Fh, respectively.

(H08) In the above-described exemplary embodiment, although the configuration in which the pull roller R11 is provided with the torque limiter TL has been described as an example, the present invention is not limited to this configuration. For example, a sensor that detects the tension exerted on the continuous sheet S may be provided, and transmission of a driving force may be controlled by switching an electromagnetic clutch on and off. In addition, the heating roller Fh, the second transfer roller T2*b*, and the sheet-feeding roller R4 may each be provided with, for example, the torque limiter TL or a one-way clutch that enables the roller to idle.

(H09) In the above-described exemplary embodiment, although it is desirable that the members R11, Fh, B, and R4 located on the downstream side rotate at a higher speed. However, since a problem of wrinkles generated in the continuous sheet S is less likely to occur at a position that is further toward the downstream side than the fixing region Q5, in which the continuous sheet S is nipped, for example, the transport speed of the pull roller R11 and the transport speed of the fixing device F may be set to be equal to each other.

(H010) In the above-described exemplary embodiment, although the configuration of an optical sensor has been described as a skew sensor, the skew sensor is not limited to the optical sensor. For example, a contact-type (hardware-type) sensor that performs detection by coming into contact with an edge end of a continuous sheet may be used.

(H011) In the above-described exemplary embodiment, although the continuous sheet S has been described as an example of a medium, the medium is not limited to a sheet, and a resin film or the like may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport roller configured to transport a continuous medium in a transport direction as a result of a transport surface of the transport roller making contact with the continuous medium;

a transfer belt that is disposed on a downstream side of the transport roller in the transport direction;

a fixing device; and a second transport roller that is disposed on a downstream side of the fixing device in the transport direction, wherein the transfer belt is configured to transfer an image onto the medium, wherein the fixing device is configured to fix, onto the medium, the image that has been transferred onto the medium, wherein the image forming apparatus is configured to control a moving speed of the fixing device to be higher than a moving speed of the transport surface when the medium is transported, wherein the image forming apparatus is configured control a moving speed of the second transport roller to be higher than a moving speed of the fixing device when the medium is transported, and wherein the image forming apparatus is configured to control an acceleration of the fixing device to be higher than an acceleration of the transport surface when driving of the second transport roller is started.

2. The image forming apparatus according to claim 1, wherein the image forming apparatus is configured to control an acceleration of the second transport roller to be higher than an acceleration of the fixing device when driving of the second transport roller is started.

3. An image forming apparatus comprising:

a transport roller configured to transport a continuous medium in a transport direction as a result of a transport surface of the transport roller making contact with the continuous medium;

a transfer belt that is disposed on a downstream side of the transport roller in the transport direction;

a fixing device; and a second transport roller that is disposed on a downstream side of the fixing device in the transport direction, wherein the transfer belt is configured to transfer an image onto the medium, wherein the fixing device is configured to fix, onto the medium, the image that has been transferred onto the medium, wherein the image forming apparatus is configured to control a moving speed of the fixing device to be higher than a moving speed of the transport surface when the medium is transported, wherein the image forming apparatus is configured control a moving speed of the second transport roller to be higher than a moving speed of the fixing device when the medium is transported, and wherein the image forming apparatus is configured to control an acceleration of the second transport roller to be higher than an acceleration of the fixing device when driving of the second transport roller is started.

* * * * *